United States Patent [19]

Enssle

[11] Patent Number: 4,528,791

[45] Date of Patent: Jul. 16, 1985

[54] ANCHORAGE FOR CLIMBING IRONS IN PARTS OF CONCRETE OR THE LIKE

[76] Inventor: Gerhard Enssle, Spitalgasse 1, D-8867 Oettingen, Fed. Rep. of Germany

[21] Appl. No.: 466,338

[22] PCT Filed: Jun. 1, 1982

[86] PCT No.: PCT/DE82/00119

§ 371 Date: Jan. 28, 1983

§ 102(e) Date: Jan. 28, 1983

[87] PCT Pub. No.: WO82/04283

PCT Pub. Date: Dec. 9, 1982

[30] Foreign Application Priority Data

May 29, 1981 [DE] Fed. Rep. of Germany ..... 3121249

[51] Int. Cl.[3] ..... E04B 1/38

[52] U.S. Cl. ..... 52/699; 52/704

[58] Field of Search ..... 52/699, 701, 704, 706, 52/711; 182/87, 90, 82

[56] References Cited

U.S. PATENT DOCUMENTS 2,785,842 3/1957 Phelps ..... 182/92

3,374,859 3/1968 Dobert ..... 52/711 X

FOREIGN PATENT DOCUMENTS 2115868 9/1983 United Kingdom ..... 182/92

*Primary Examiner*—Donald G. Kelly

*Assistant Examiner*—Naoko N. Slack

*Attorney, Agent, or Firm*—Browdy and Neimark

[57] ABSTRACT

An arrangement for anchoring climbing irons in concrete or the like to support devices adapted for being secured on formwork, wherein the climbing irons are to be connected with the support devices after removal of the formwork. Each climbing iron includes a securing flange and means for carrying a screw joint member. Each support device has a body including one side extending parallel to, and configured for engaging the securing flange. The body further has structural formations, one set disposed on the body's one side for attaching the climbing iron to the support device and the other set on the body's other side for attaching the support device to concrete.

12 Claims, 13 Drawing Figures

Figure 2:
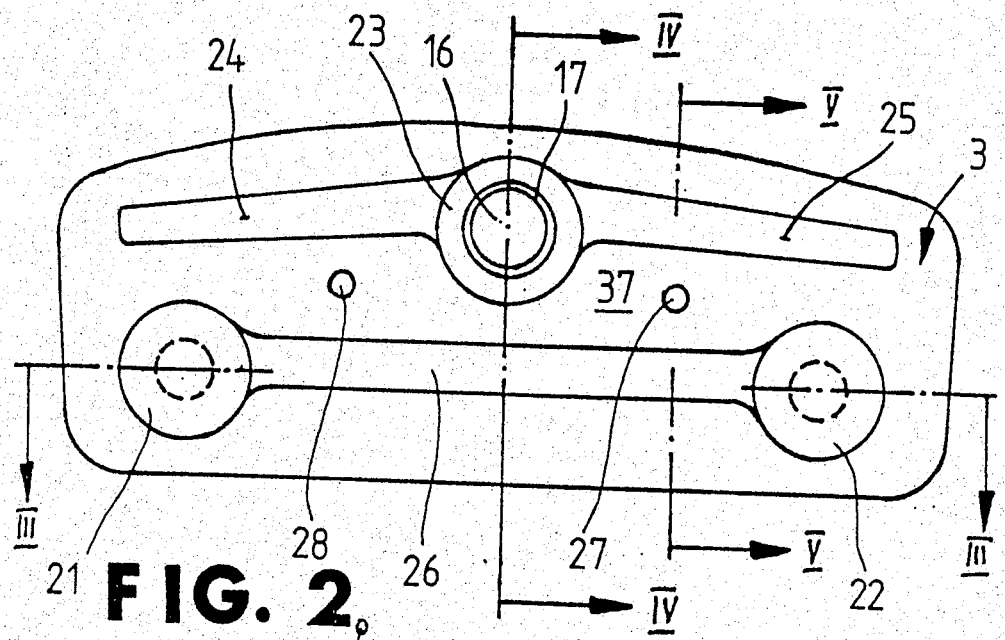

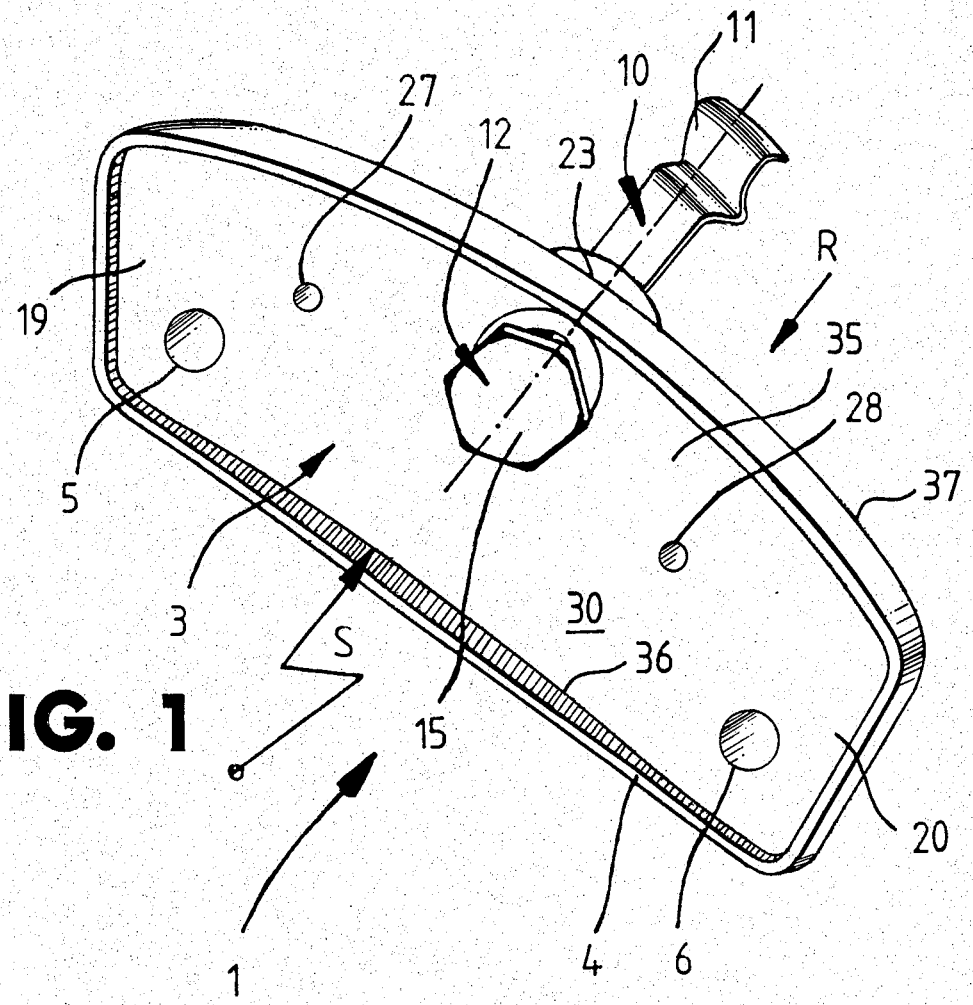
FIG. 1
FIG. 8
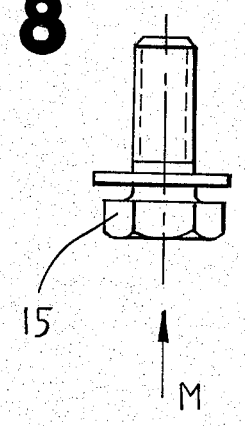

ANCHORAGE FOR CLIMBING IRONS IN PARTS OF CONCRETE OR THE LIKE

The invention concerns an anchorage for climbing irons in parts made of concrete or the like with placing parts to be secured on formwork, whereby said climbing irons have to be connected with the placing parts after the removal of the formwork.

An anchorage of this type is described e.g. in the U.S. Pat. No. 3,374,859 where a U-shaped bent round steel bracket is supported at its two ends in two separate placing parts of metal and is secured in the use position by means of a spring plate latch device. Apart from the fact that this type of climbing iron anchorage causes high material costs, is technically very expensive and moreover is relatively insecure, its two separate placing parts are difficult to adjust during assembly on the formwork.

It is therefore the object of the invention to create an anchorage of the type above by means of which the material cost of the placing parts and the wage costs during the installation thereof are substantially reduced as against the known anchorage.

This object is inventively solved in that for each climbing iron with a securing flange and a screw joint, a placing part is provided of a substance with at least the compressive strength of concrete, and that the placing part has a basic body extending parallel to said securing flange, while said basic body, on the side which is visible after the removal of the formwork, has three securing points for the climbing iron, as well as on the opposite concrete side at least one tension-loadable dowel as the top securing point for the screw joint which passes through a borehole, and two supports loadable for pressure and thrust as the further lower securing points. With this anchorage to secure a climbing iron on a concrete wall or the like, on the formwork only a relatively flat placing part is mounted with only small installed depth in the concrete wall, which in contrast to the two placing parts of the known anchorage causes only a fraction of the material and wage costs. In addition the invention placing part can be mounted on a concrete wall with the admissible minimum wall thickness of about 80 to 100 mm, which is not possible when using the two placing parts of the known anchorage.

In the DE-GM 77 12 733 the anchor dowels to be inserted flush in a concrete construction are described for the subsequent fastening of connecting elements. These anchor dowels are, however, exposed to uncontrollable tensional, compressive and thrust loadings. A climbing iron anchor based on this principle, due to the numerous welding points on the placing part and the respectively large number of anchor dowels needed for a climbing iron, would be fairly costly in contrast to the inventive anchorage for climbing irons, and therefore uneconomical when used in large numbers.

Using the inventive anchorage a climbing iron can be secured on a concrete wall as is described e.g. in DE-PS 26 50 180. For this climbing iron in particular one single screw is adequate as a screw joint. For climbing irons which have to be secured on a wall by a plurality of screws, the supports can be correspondingly adapted.

The invention provides that the dowel engages in the basic body of the placing part and is held in the borehole by friction. Thus the anchorage can be assembled even before transportation to the building site. Moreover the dowel does not need to specially secured after mounting of the placing part on the formwork against accidentally falling or sliding out.

An advantageous further development of the invention comprises the fact that the lower securing points on the visible side of the placing part has two recesses as the bearing points for the cams formed on the climbing irons. This design feature facilitates in particular the assembly work of mounting the climbing iron on the finished wall to a substantial extent: after introducing its cams in the relevant recesses of the placing part, the climbing iron only has to be secured by a screw held on its securing flange and then secured in its operating position.

Further it is advantageously provided that on the placing part behind the recesses on its concrete side a boss-shaped projection forms a support. Thus the compressive and thrust forces taking effect from the climbing iron on the placing part are safely conducted into the wall.

The same effect is attained according to the invention in that the placing part on its concrete side has battens projecting toward the wall with preferably dove-tailed cross-section as the support. Moreover these battens serve to reinforce the basic body of the placing part against bending and/or twisting.

The invention further provides that the side visible after formwork removal of the placing part is formed as a cylindrical surface, and that the abutting surface in the operating position of the securing flange of the climbing iron is correspondingly curved. This is a preparatory measure for a possible application of the climbing iron on an arched, especially a concave arched wall surface, such as shaft walls etc.

According to the invention it is further intended that on the side visible after formwork removal of the placing part a ridge is formed around the edge, from which a narrower edge abuts the formwork. In this way the placing part abuts the formwork with a small surface but with high surface pressure when it is mounted by means of tacks or the like on the formwork, and thus it prevents the flow of cement wash onto the surface of the basic body which is surrounded by the ridge, against which basic body the surface of the securing flange of the climbing iron abuts after removal of the form. This surface then does not have to be specially cleaned.

If the climbing iron is to be arranged on an arcuate surface, as mentioned above, the peripheral ridge would be an impediment when installing the placing part. Therefore according to the invention, between the ridge and the basic body of the placing part, a predetermined break line is provided, along which the ridge can be broken off if necessary. Then the surface of the basic body during installation of the placing part abuts directly on the formwork.

For easier mounting of the placing part on its formwork it is inventively provided with holes for tacks or the like. Should the placing part have to be mounted on a steel formwork, the entire anchorage can be mounted on such a formwork in that with the aid of a screw guided through a hole in the formwork and screwed into the dowel, it is held on the formwork.

Finally it is provided by the invention that the placing part is made of an injection moldable material, especially of a duro- or a thermoplastic material. The simple manufacture and the relatively cheap material make the inventive placing part into an economical mass production article.

Figure 3:
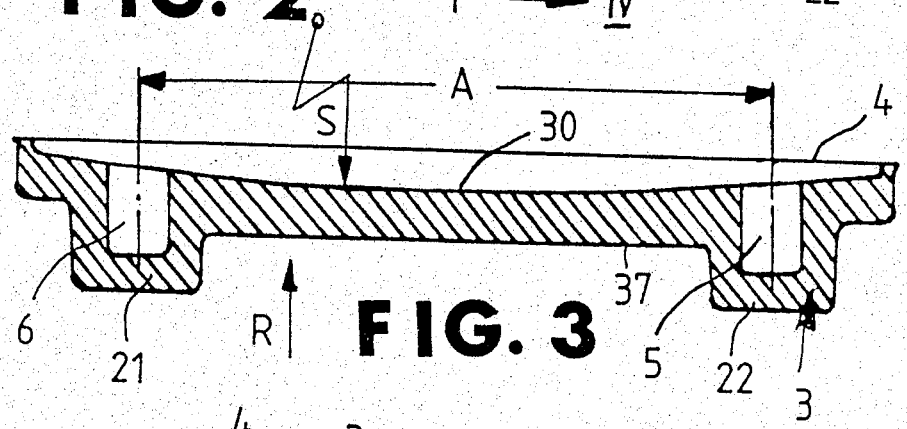
Figure 4:
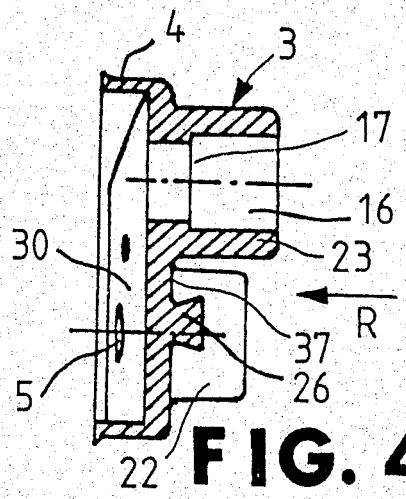
Figure 5:
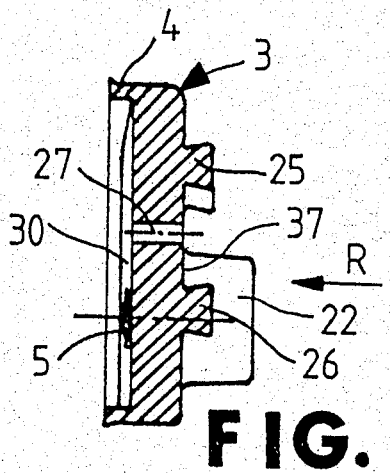
Figure 6:
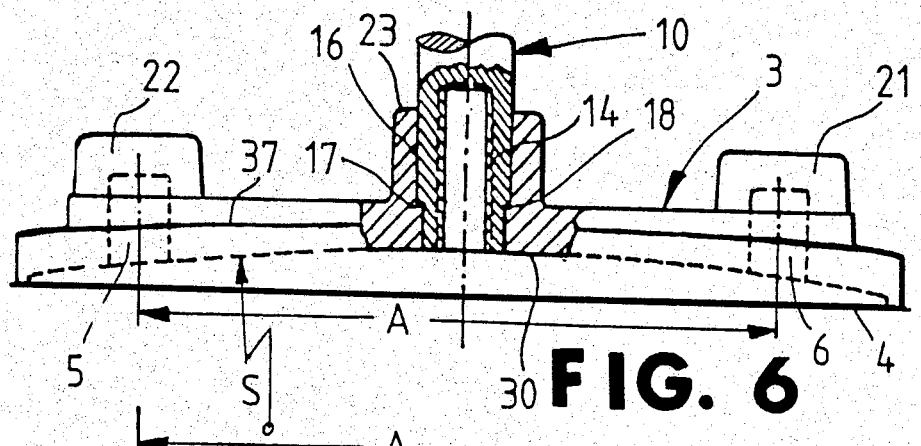
Figure 7:
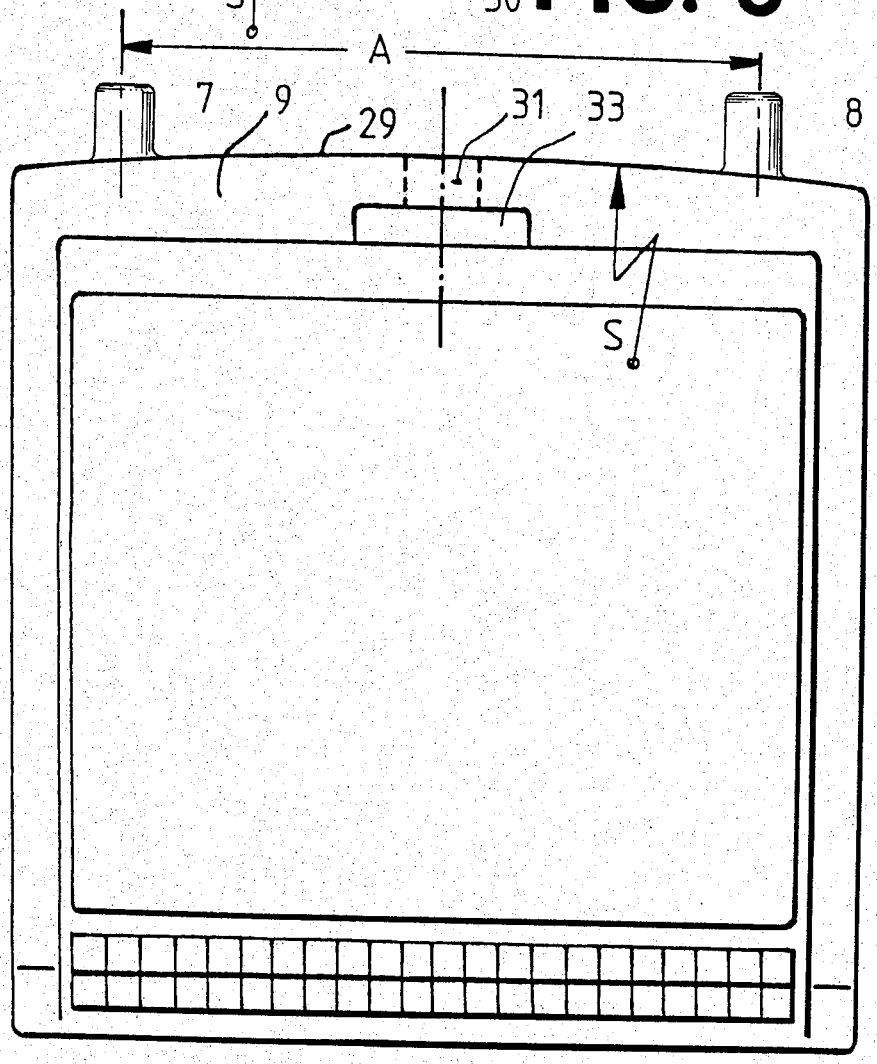
Figure 9:
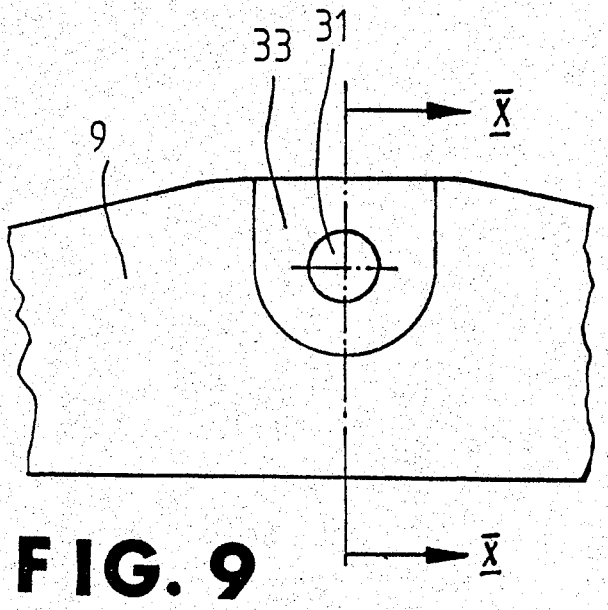
Figure 10:
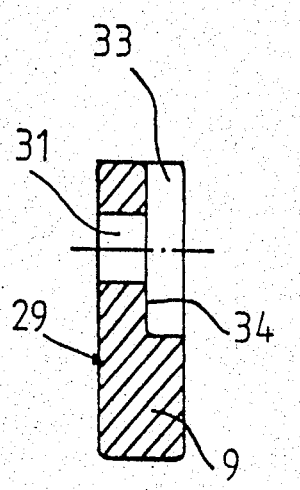
Figure 11:
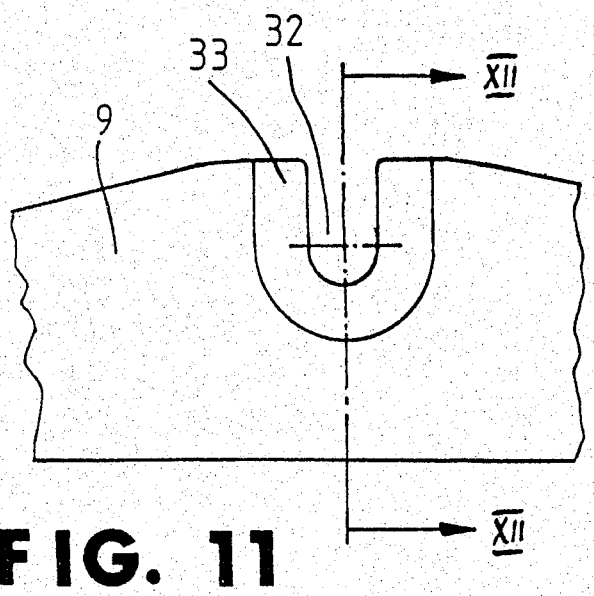
Figure 12:
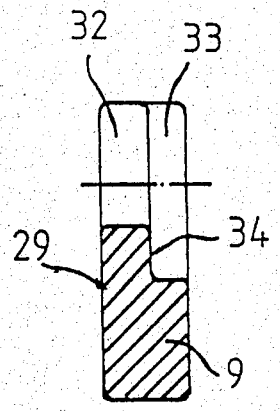
Figure 13:
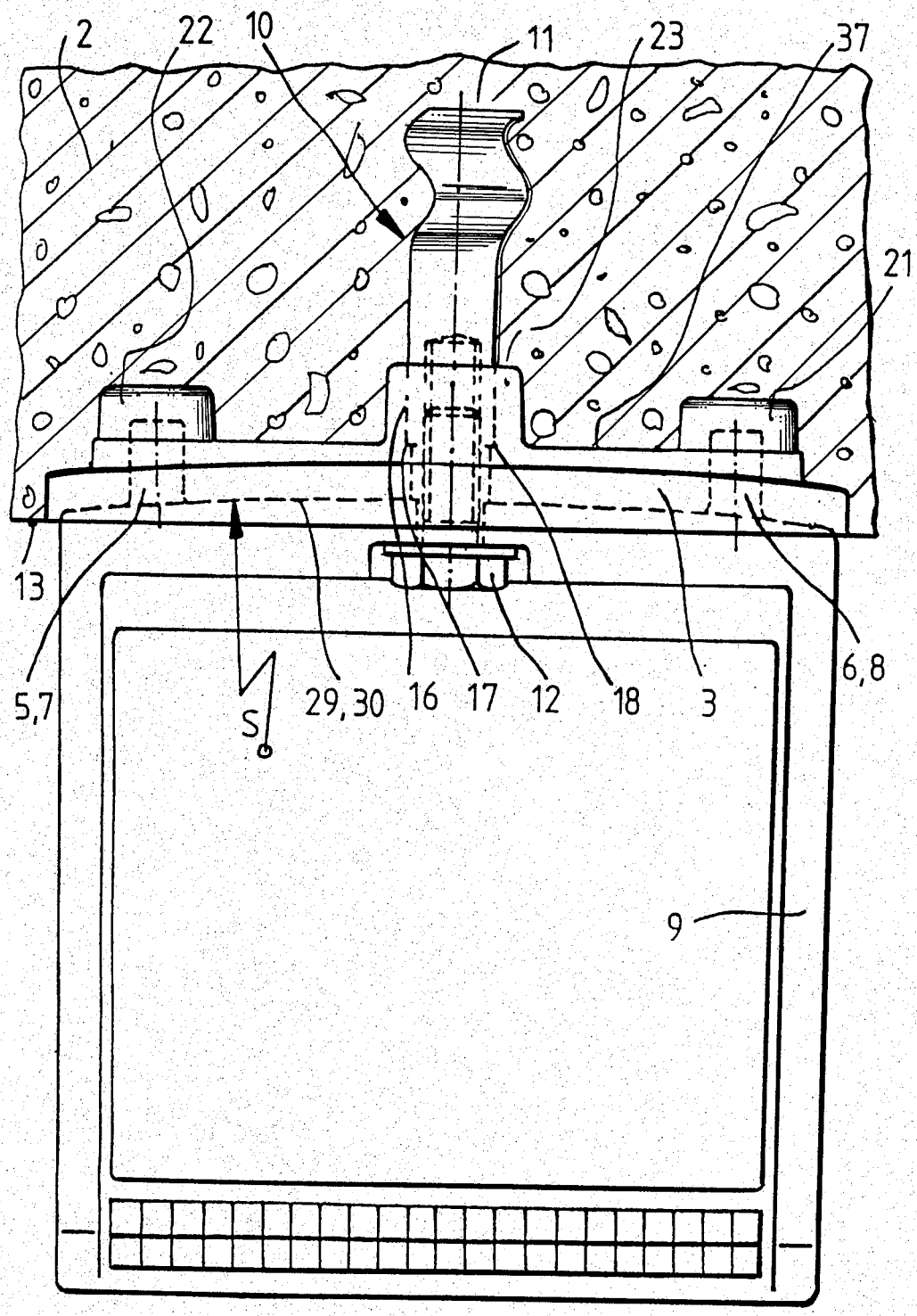

Further features, details and advantages emerge from the following description of a preferred embodiment of the invention, as well as from the enclosed drawing. The following show:

FIG. 1 a perspective view of the inventive anchorage with a placing part and a dowel inserted therein;

FIG. 2 a rear view of the placing part in the direction of arrow R in FIG. 1;

FIG. 3 a longitudinal section through the placing part along the section line III—III in FIG. 2;

FIG. 4 a cross-section through the placing part along the section line IV—IV in FIG. 2;

FIG. 5 a cross section through the placing part along the section line V—V in FIG. 2;

FIG. 6 a partially cut-away plan view of the placing part;

FIG. 7 a plan view of a climbing iron to be secured on the placing part;

FIG. 8 a view of the screw bolt with which the climbing iron is mounting on the placing part;

FIG. 9 a partial view of the climbing iron in the direction M of FIG. 7 showing a first embodiment of an aperture for the screw bolt;

FIG. 10 a cross-section through the climbing iron along the section line X—X in FIG. 9;

FIG. 11 a partial view of the climbing iron in the direction M of FIG. 7 showing a second embodiment of an aperture for the screw bolt;

FIG. 12 a cross-section through the climbing iron along the section line XII—XII in FIG. 11 and FIG. 13 a total view of the inventive device fitted into a concrete wall with dowel, placing part and a climbing iron secured thereon.

FIG. 1 shows an inventive placing part 3 with a dowel 10 passing through it in a borehole 16 before installation in the negative formwork for a wall 2, especially a concrete wall or the like.

The commercially available dowel 10 has on its end which is set in concrete when positioned, a hook-shaped compression 11 to increase its hold on the wall 2, as well as an internal thread 14 on the other end from its front for a screw 15 to be screwed into said end.

The borehole 16 of the placing part 3 has at about its midway length a heel 17 on which in the direction R a collar 18 formed on dowel 10 can be supported, so that the dowel 10 is secured against further extraction in direction R from the aperture 16 of the placing part 3, as shown in FIG. 2, 4 and 13.

The placing part 3 has in addition near its ends 19, 20 two blind bores 5, 6 arranged at a spacing A from each other. In the operating position two correspondingly formed cams 7,8 are supported in said bores 5, 6 equally at a spacing A from each other of a climbing iron 9 to be mounted on the placing part 3, so that the climbing iron 9 is fixed securely against tilting and slipping on the placing part 3, as shown in FIG. 13.

The placing part 3 has on its concrete side 37 in the area of the bores 5, 6 and of borehole 16 reinforcements 21,22,23 and stiffeners 24,25,26 with respectively dovetailed cross section, as shown in FIG. 2 to 6. The latter increase the form stability of the placing part 3. On the other hand the holding surfaces of the placing part 3 which are decisive for a close and lasting connection with the material of wall 2 which contacts the placing part 3 in its operating position are thereby enlarged. Lastly the reinforcements 21,22,23 on the back of the placing part 3 ensure that the edges of the bores 5, 6 on its front do not break out when the cams 7,8 of the climbing iron 9 on the placing part 3 exert especially high loads due to extraordinary load conditions on the edges of the recesses 5, 6.

As shown in FIG. 1,2 and 5, the placing part 3 also has two holes 27,28 passing right through it, for nails or the like (not shown here), by means of which the placing part 3 is fixed on the negative formwork for the wall 2 before its construction, in order to fix part 3 where it will later be used.

Since the climbing irons 9 of the type shown in FIG. 7 and 8 are usually in manholes with a round cross-section having a diameter of e.g. 1,000–1,200 mm, the surface facing shaft wall 2 of the securing flange 29 is arched with a corresponding radius S. Thus the counterface 30 corresponding to this surface of the securing flange 29 on the placing part 3 can also be arched with the same radius S, if this is desirable.

The climbing iron 9 or other parts, consoles, instruments, risers, markings, fenders, lighting installations or the like, which have to be mounted on a wall 2 using the inventive anchorage 1 normally have on their side facing the wall an aperture 31, preferably of round cross-section, through which the screw joint 12 can be led as shown in FIG. 9 and 10.

However it is also possible that on climbing iron 9 or on any other placing part to be secured on wall 3 a slit 32 which is open upwards in the operating position can be provided instead of the aperture 31, without thereby reducing the safety of the retention and thereby the safety of the persons using the ladders.

The embodiment with a slit 32 opening upwards has the advantage that the climbing iron 9 can be mounted or removed without the joint 12 having to be wholly unscrewed, as is the case for instance with a climbing iron 9 having a closed aperture 31.

In both possible cases of the design of a climbing iron 9, however, there should be in the junction area a recess 33 on the aperture 31 and/or on slit 32, in order to offer a smooth bearing surface 34 to the screw head or to the nut of a joint 12, so that the joint 12 is really exclusively tension loaded and is not additionally loaded for flexure. The latter would be the case if the bearing surface for the screw head or for the nut of a joint 12 were inclined against the axis thereof, and thereby the screw head would only be supported on one side.

According to the invention the placing part 3 is provided on its side facing the climbing iron 9 to be secured with a peripheral ridge 4, whose peripheral edge—in contrast to the surface 30 arched with radius S, described in the previous embodiment—is located in one plane. Along the seam between the ridge 4 and the surface 30, a predetermined break point 36 is provided, along which the ridge 4 can be broken off using a simple tool. If the placing part 3 were to be inserted in a concavely curved wall surface, the ridge 4 could be an impediment, at least when the wall 2 is being erected. In this case the ridge 4 can be removed by breaking off along the predetermined break line 36.

The placing part 3 can—in contrast to the embodiment of the inventive subject described above and shown in the drawing below—have any other expedient and reasonable form and size, to the extent that this is required by the type and size of the object to be secured. Depending on the use envisaged, it is preferably made of a material which is suitable as to temperature, form, acidity, lye, seawater, and/or UV rays, is resistant to hydrocarbons, insensitive to mechanical loads and is especially resistant to impact, and made particularly of plastic or metal. The placing part 3 of the inventive anchorage 1 should be made, for use in a wall of concrete, reinforced concrete, asbestos cement, masonry and the like, preferably of a plastic or a duroplastic or thermoplastic material. Of course other plastics obtainable in the trade can be used, to the extent that they meet the demands upon them as formulated above.

In conclusion it should be expressly noted that the inventive anchorage can be mounted on curved wall surfaces. It can find applications with concrete prefabricated parts, on shaft rings, dams, sluice-gate walls, wall surfaces of filtration plants, supply tunnels, silos, towers and other buildings both for construction above and below ground level.

I claim:

1. An arrangement for anchoring climbing irons in concrete or the like to support devices adapted for being secured on formwork, wherein the climbing irons are to be connected with the support devices after removal of the formwork, said arrangement comprising:

each climbing iron including a securing flange and means for carrying a screw joint member; and a support device for each climbing iron, said support device being of a material with at least the compressive strength of the concrete in which it is disposed, said support device having a body including one side extending parallel to, and configured for engaging, said securing flange, said body further having two sets of distinct, spaced, structural formations, one set being disposed on said body one side for attaching said climbing iron to said support device, and the other set being disposed on a side of said body opposite said one side for attaching said support device to said concrete, said other set of formations comprising two, substantially horizontally aligned protrusions loadable for pressure and thrust and at least one tension-loadable dowel disposed above said two protrusions.

2. The arrangement of claim 1 wherein said dowel extends through a borehole in said body from said one side to, and beyond, said other side, said dowel at said opposing side including means for receiving said screw joint member carried by said climbing iron.

3. The arrangement according to claim 2 wherein the dowel engages with, and is held firmly by friction in said borehold.

4. The arrangement according to one of claims 1, 2 or 3, wherein said climbing iron securing flange includes a pair of protruding cams, and said one set of formations include two, substantially horizontally aligned bores, each bore being coaxially aligned with a respective one of said protrusions on said other side of said body, said bores defining bearing points for said cams.

5. The arrangement according to claim 4, wherein said protrusions are boss-shaped.

6. The arrangement according to claim 4, wherein said support device has on its other side stiffeners projecting away therefrom with preferably a dove-tailed cross-section for support.

7. The arrangement according to claim 4, wherein said one side defines a cylindrical surface, and the surface of the securing flange which abuts said one side is correspondingly curved.

8. The arrangement according to claim 4, wherein said one side includes a peripheral ridge having a narrow edge for abutting the formwork.

9. The arrangement according to claim 8, wherein a break line separates the ridge and the body.

10. The arrangement according to claim 4, wherein said support device includes holes therethrough for tacks or the like for securing it on the formwork.

11. The arrangement according to claim 4, wherein said support device is made of injection moldable material.

12. The arrangement according to claim 4, wherein said support device is made of a duroplastic or a thermoplastic material.

* * * * *